US006325134B1

(12) United States Patent
Mullet

(10) Patent No.: US 6,325,134 B1
(45) Date of Patent: Dec. 4, 2001

(54) DISCONNECT FOR SECTIONAL DOOR OPERATION

(75) Inventor: Willis J. Mullet, Pensacola Beach, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/499,488

(22) Filed: Feb. 7, 2000

(51) Int. Cl.[7] ..... E05F 11/00
(52) U.S. Cl. ..... 160/189; 160/201; 49/200
(58) Field of Search ..... 160/189, 188, 160/201, 310, 311; 49/199, 200; 74/625; 292/DIG. 36; 16/DIG. 1

(56) References Cited

U.S. PATENT DOCUMENTS

| | | | | |
|---|---|---|---|---|
| 3,512,302 | * | 5/1970 | Sivin et al. | 160/189 |
| 4,085,629 | | 4/1978 | Fogarollo | 74/625 |
| 4,098,023 | | 7/1978 | Slopa | 49/139 |
| 4,191,237 | * | 3/1980 | Voege | 160/188 |
| 4,472,910 | | 9/1984 | Iha | 49/139 |
| 4,618,174 | | 10/1986 | Duke | 292/135 |
| 4,852,706 | | 8/1989 | Pietrzak et al. | 192/8 |
| 4,884,831 | | 12/1989 | Emon | 292/38 |
| 4,993,533 | | 2/1991 | Brown | 192/114 |
| 5,419,010 | | 5/1995 | Mullet | 16/198 |
| 5,509,233 | | 4/1996 | Peterson | 49/139 |
| 5,698,073 | * | 12/1997 | Vincenzi | 160/188 |
| 5,931,212 | | 8/1999 | Mullet | 160/188 |
| 6,055,885 | * | 5/2000 | Shea | 160/310 |
| 6,092,582 | * | 7/2000 | Liu | 160/188 X |

* cited by examiner

*Primary Examiner*—David M. Purol
(74) *Attorney, Agent, or Firm*—Renner, Kenner, Greive, Bobak, Taylor & Weber

(57) ABSTRACT

An operating system (10) for controllably moving a sectional door (D) between open and closed positions comprising a counterbalancing system (30) having a drive tube interconnected with the sectional door (D) and an operator motor (40) mounted adjacent to the drive tube (31), a drive train interconnecting the drive tube (31) and the operator motor (40) for selectively driving the drive tube (31) for moving the sectional door (D) between the open and closed positions, a coupler (50) in the drive train selectively retractable from a driving position and a remotely-actuated disconnect assembly (60) operatively attached to the coupler (50), wherein the disconnect assembly (60) retracts the coupler (50), whereby the sectional door (D) may be manually moved toward either of the open position and the closed position.

28 Claims, 5 Drawing Sheets

DISCONNECT FOR SECTIONAL DOOR OPERATION

TECHNICAL FIELD

The present invention generally relates to operators for doors. In particular, the present invention relates to power-driven operators for opening and closing doors. More specifically, the present invention relates to a disconnect for a jack shaft operator that prevents unauthorized access. More particularly, the present invention relates to a motorized operator for a sectional overhead garage door having a disconnect for separating the drive motor from the counterbalance system that is not easily accessible to thereby preclude forced or unauthorized entry.

BACKGROUND ART

Garage door operators that directly connect to sectional garage doors are well known and must have a manual disconnect that allows the operator to be disconnected from the door. The disconnect mechanism is required to make it possible to operate the door manually in the case of power failures, fire, or emergency situations where entrapment of a person or object occurs. In these instances, the disconnect operates to allow manual displacement of the door to free any obstruction beneath the door or make it possible to enter or exit the structure.

In a trolley-type operator, the manual disconnect is typically a rope extending from the trolley with a handle as will be described below. The majority of motorized operators for residential garage doors employ the trolley-type system. These systems apply force to a section of the door powering it between the open and closed positions. In normal situations, the trolley-type door operator directly connects to the top section of a segmented garage door, and, for universal application, may be powered to operate doors of vastly different size and weight, even with little or no assistance from a counterbalance system. As its name suggests, the trolley-type mechanism has a trolley that operatively connects the top section of the door to the motor. As the door moves between the opened and closed positions, the trolley translates along a track toward the rear and front of the garage, respectively. The disconnect rope for trolley-type operators is typically suspended from the trolley and operates to disconnect the operator from the top door section.

The disconnect rope and handle must extend within six feet of the floor to permit grasping and actuation by a person. In the case of a garage opening for a single car, the centrally-located disconnect rope and handle, being positioned medially, can catch on a vehicle during movement or be difficult to reach due to its positioning over a vehicle located in the garage. As a further detriment, placement of the disconnect rope on the trolley over the vehicle makes it difficult to find the rope in a darkened garage during a power outage or the like.

In terms of security, the trolley's movement places the rope closest to the garage door opening when the garage door is closed. When windows are added to the top section of the garage door, a window may be broken, and the disconnect, easily within reach of an intruder, may be used to separate the operator from the door preparatory to manually opening the garage door.

A separate concern is created by other known disconnects that are weighted or sprung toward the connected position. The spring or leverage must be overcome to operate the disconnect such that the door can be moved. These biased disconnects allow for automatic engagement of the disconnect when the door is manually moved to the original position of the door, i.e., the position where the disconnect was disengaged. In some bias disconnects, the disconnect will automatically engage when the trolley is moved by the motor to the position that the door was in. Disadvantageously, a user will have to wait until the trolley is in the former position in order to engage a disconnect mechanism. This type of system is very limiting because the trolley will engage the disconnect in only one position. Furthermore, the user is unable to control engagement of the disconnect mechanism, as the mechanism automatically engages as soon as the trolley reaches the disengagement position. This automatic disengagement prevents manually moving the door a short distance and then manually engaging the disconnect mechanism at the new position, which may be useful when an object is lodged beneath the door.

DISCLOSURE OF THE INVENTION

Therefore, an object of the present invention is to provide an operator having a disconnect with a disconnect handle that does not interfere with the ingress or egress of a vehicle. Another object of the present invention is to provide such an operator that does not require trolley rails and a moving trolley that has a disconnect handle but rather has a disconnect handle positioned in a fixed location within the garage, such that it is easy to locate.

A further object of the present invention is to provide an operator mounted in a fixed location, having a disconnect located on the operator that is actuated by a handle attached to the disconnect. Yet another object of the present invention is to provide an operator having a disconnect with a handle that may be positioned away from windows and other points of entry, which could be used to wrongfully access the disconnect. Still another object of the present invention is to provide an operator having a disconnect that is actuated by a handle connected to the disconnect by a cable, wherein the handle is mounted at any desired location in the structure and the cable is routed to the disconnect.

Another object of the present invention is to provide an operator having a disconnect that may be engaged independently of door position. A further object of the present invention is to provide such an operator having a disconnect that separates the driving mechanism from the counterbalance system. Yet another object of the present invention is to provide an operator having a disconnect that includes a retractable coupler attached to the drive train such that the drive train and coupler rotate together, wherein the coupler is selectively retractable between engaged and disengaged positions respectively applying/releasing the motor force to the counterbalance system. Still another object of the present invention is to provide such an operator where the drive shaft and driven shaft are connected by a pair of gears, and the coupler selectively engages the gear on the drive shaft to apply the motor force to the gear and consequently to the driven shaft. Another object of the present invention is to provide such an operator with a gear having a plurality of recesses for receiving a tooth mounted on the coupler, wherein engagement of the motor to the drive gear occurs when the coupler rotates to a position where the tooth engages the of the recesses, thereby rotationally driving the gear.

Therefore, the present invention provides an operating system for controllably moving a sectional door between open and closed positions, including a counterbalancing system having a drive tube interconnected with the sectional door and an operator motor mounted adjacent to the drive tube, a drive train interconnecting the drive tube and the operator motor for selectively driving the drive tube for moving the sectional door between open and closed positions, a coupler in the drive train selectively retractable from a driving position, and a remotely-actuated disconnect assembly operatively attached to the coupler, wherein operation of the disconnect assembly retracts the coupler, whereby the sectional door may be manually moved toward either of the open position or the closed position.

PREFERRED EMBODIMENT FOR CARRYING OUT THE INVENTION

Figure 1:
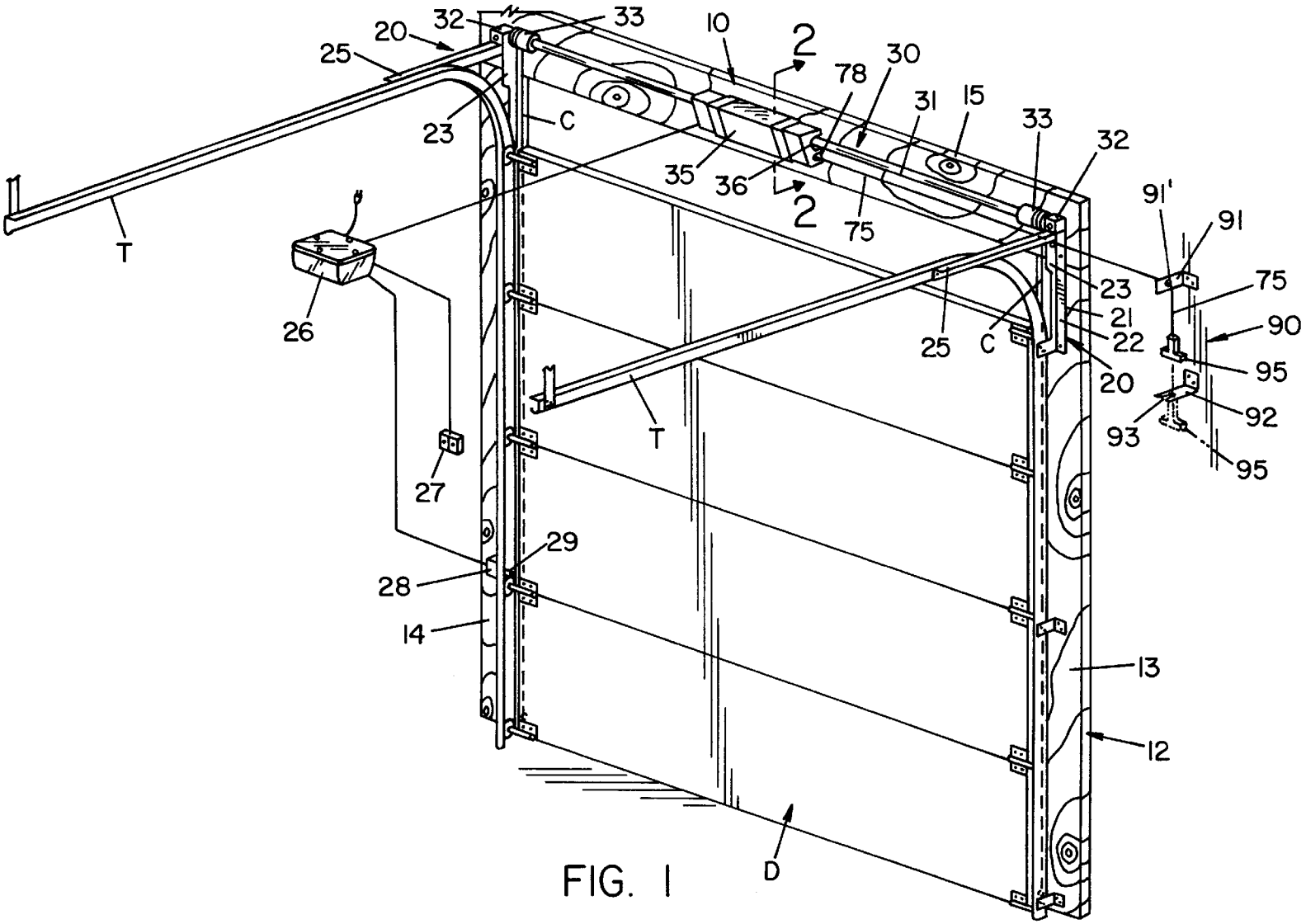
FIG. 1 is a perspective view of garage door having a disconnect according to the present invention showing a fixed location disconnect handle.
Figure 2:
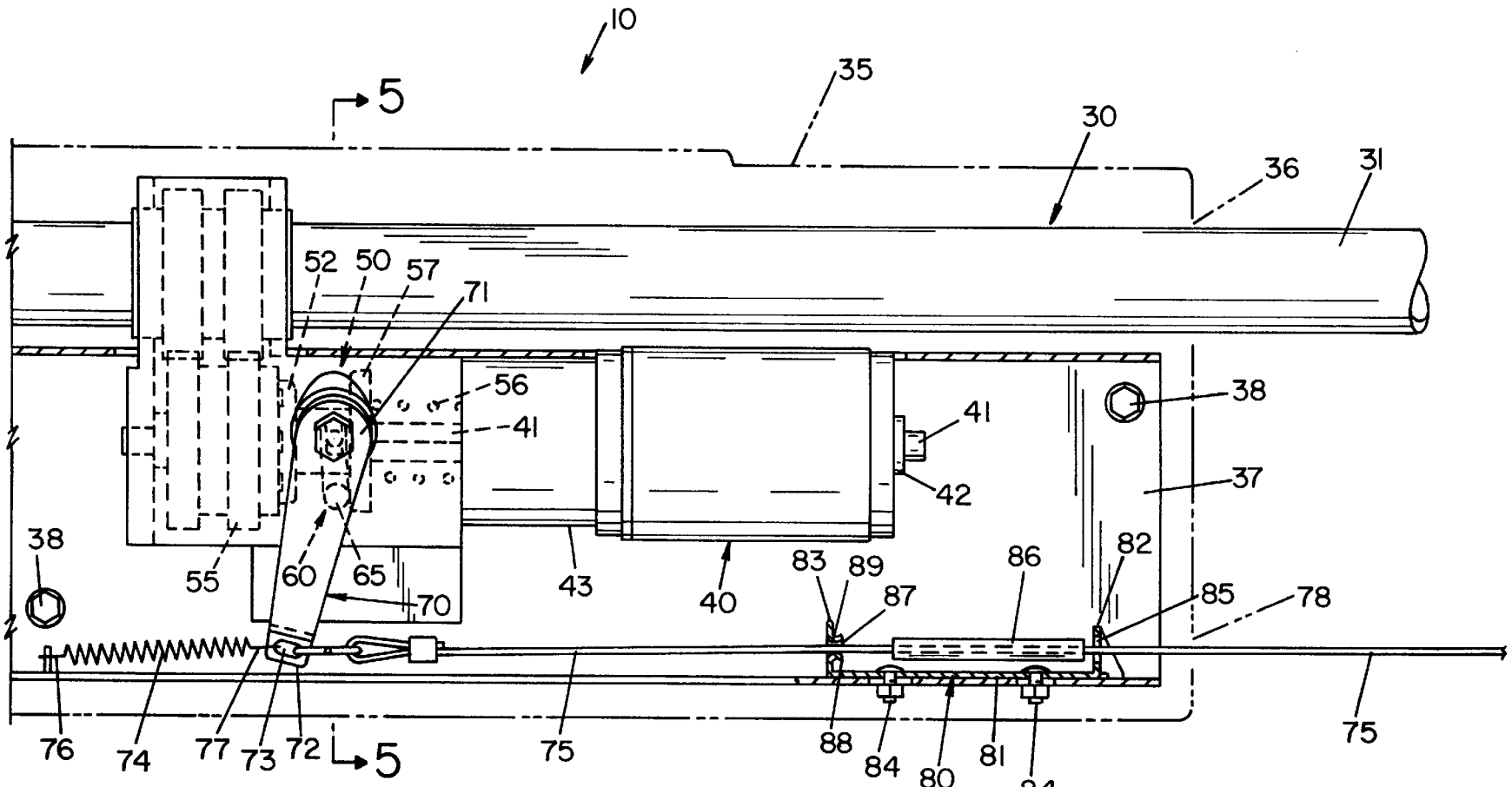
FIG. 2 is a fragmentary sectional side elevational view of an operator according to the present invention taken substantially along line 2—2 in FIG. 1, having the operator cover removed to show internal detail of the operator and particularly the disconnect depicted in the engaged position.

A motorized operator according to the concepts of the present invention is generally indicated by the numeral 10 in FIGS. 1–5 of the drawings. The operator system 10 is shown mounted in conjunction with a conventional sectional door D of a type commonly employed in garages for residential housing. The opening in which the door D is positioned for opening and closing movements relative thereto is defined by a frame, generally indicated by the numeral 12, that consists of a pair of spaced jambs 13, 14 which, as seen in FIG. 1, are generally parallel and extend vertically upwardly from the floor (not shown). The spaced jambs 13, 14 are spaced and joined at their vertically upper extremity by a header 15 to thereby delineate a generally inverted U-shaped frame 12 around the opening for the door D. The frame 12 is normally constructed of lumber, as is well known to persons skilled in the art, for purposes of reinforcement and facilitating the attachment of elements supporting and controlling door D, including the operator system 10.

Affixed to the spaced jambs 13, 14 proximate the upper extremities thereof and the lateral extremities of the header 15 to either side of the door D are flag angles, generally indicated by the numeral 20. The flag angles 20 generally consist of L-shaped vertical members 21 having a leg 22 attached to an underlying spaced jamb 13, 14 and a projecting leg 23 preferably disposed substantially perpendicular to the leg 22 and, therefore, perpendicular to the spaced jambs 13, 14.

Flag angles 20 may also include an angle iron 25 positioned in supporting relation to tracks T, T located on either side of door D. The tracks T, T provide a guide system for rollers attached to the sides of door D, as is well known to persons skilled in the art. The angle irons 25 normally extend substantially perpendicular to the spaced jambs 13, 14 and may be attached to the transitional portion of tracks T, T between the vertical section and the horizontal section thereof or in the horizontal section of tracks T, T. The tracks T, T define the travel of the door D in moving upwardly from the closed to the open position and downwardly from the open to the closed position.

The operator system 10 may be electrically interconnected with a ceiling unit, generally indicated by the numeral 26, which may contain a power supply, a light, a radio receiver with antenna for remote actuation of operator system 10 in a manner known in the art, and other operational peripherals. The ceiling unit 26 may be electrically interconnected with a wall unit 27 having an up/down button, a light control, and controls for other known functions. As the door is normally locked when closed, the ceiling unit 26 may also electrically interconnect with, for example, an electric autolatch/unlatch 28 having a locking bar 29 that is extensible through an aperture in one of the tracks T to lock the door D in the closed or other preselected positions. The latch 28 may have a manual control that at least provides for manual unlatching in the event of a power failure.

With continued reference to FIG. 1, the operator system 10 mechanically interrelates with the door D through a counterbalance system, generally indicated by the numeral 30. As shown, the counterbalance system 30 includes an elongate drive tube 31 extending between tensioning assemblies 32, 32 positioned proximate each of the flag angles 20. While the exemplary counterbalance system 30 depicted herein is advantageously in accordance with U.S. Pat. No. 5,419,010, incorporated herein by reference, it will be appreciated by persons skilled in the art that the operator system 10 could be employed with a variety of torsion-spring counterbalance systems. In any instance, the counterbalance system 30 includes cable drum mechanisms 33 positioned on the drive tube 31 proximate the ends thereof which rotate with drive tube 31. The cable drum mechanisms 33 each have a cable C reeved thereabout that is affixed to the door D preferably proximate the bottom, such that the rotation of the cable drum mechanisms 33 operates to open or close the door D. As seen in FIG. 1, the operator system 10 has an operator housing 35 that may conveniently enclose a length of the drive tube 31. While the drive tube 31 is depicted as a hollow tubular member that is non-circular in cross section, it is to be appreciated that circular drive tubes, solid shafts, and other types of driving elements that rotate cable drums, such as cable drum mechanisms 33, may be employed in conjunction with the operator system 10 of the instant invention and are encompassed within this terminology and the context of this specification.

The operator housing 35 has U-shaped slots 36 at either end through which drive tube 31 extends. Operator housing 35 has a mounting plate 37 that may be attached to the header 15 as by a plurality of cap screws 38. While operator housing 35 is shown mounted on drive tube 31 substantially medially between the cable drum mechanisms 33, 33 it is to be noted that with the depicted counterbalance system 30, the operator housing 35 may be mounted at any desired location along drive tube 31 should it be necessary or desirable to avoid an overhead or wall obstruction in the particular garage design.

Referring to FIGS. 2 through 5, positioned within operator housing 35 is an operator motor, generally indicated by the numeral 40. The operator motor 40 may be a conventional electric motor that is designed for stop, forward, and reverse rotation of a motor shaft 41, which may be supported in suitable bearings 42 and encased in a motor housing 43. One exemplary motor is that described in U.S. Pat. No. 5,931,212, which is incorporated herein by reference. The operator motor 40 is selectively connected to the counterbalance system 30 by a coupler, generally indicated by the numeral 50. Coupler 50 may include an annular hub 51 having a crenulated collar 52 extending therefrom. Collar 52 has a plurality of teeth 53 formed to be received within suitable recesses 54 on drive gear 55, as will be described below. Coupler 50 has an axial bore (not shown) for receiving drive shaft 41 and sized to allow axial movement of coupler 50 along shaft 41.

Figure 5:
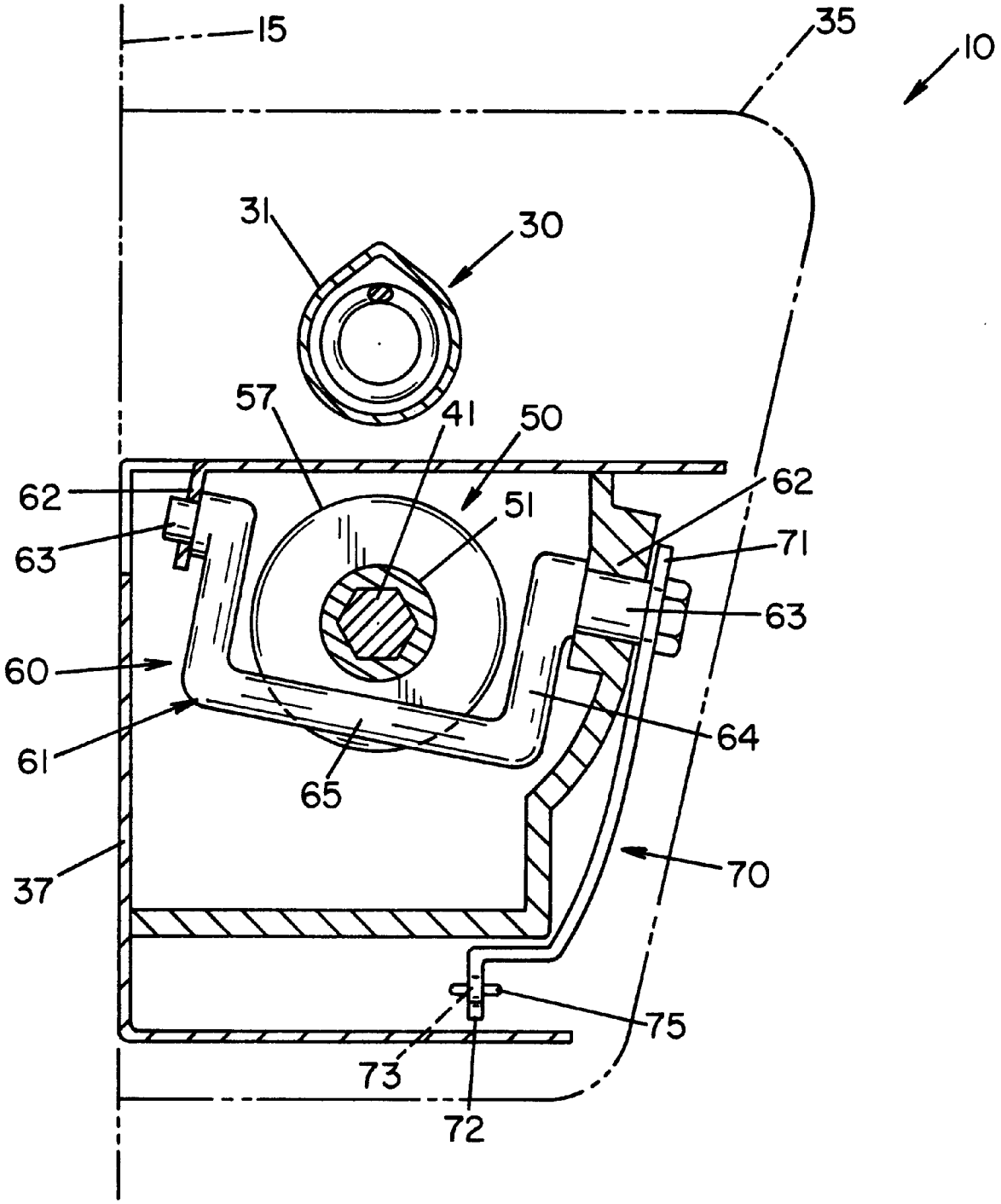
FIG. 5 is a sectional side elevational view taken substantially along line 5—5 of FIG. 2 showing a disconnect according to the present invention having an arm operatively attached to a yoke that is in operative contact with the disconnect coupler.

Coupler 50 and shaft 41 are rotationally coupled, such that coupler 50 rotates as shaft 41 rotates. The coupler 50 and shaft 41 may be rotationally coupled by any known method including a key, or as shown in FIG. 5, shaft 41 may be hexagonal and coupler 50 may be provided with a hexagonal axial bore, such that the hexagonal faces of the bore and shaft 41 transmit the rotation of the shaft 41 to coupler 50.

To bring motor 40 into engagement with drive gear 55, the coupler 50 slides axially outwardly away from motor 40 until teeth 53 are engaged within the teeth receiving recesses 54 on drive gear 55. As shown, coupler 50 may be biased toward engagement with drive gear 54 by a spring 56. To accommodate a spring 56 having a bore sufficiently large to avoid contact with drive shaft 41 and to further allow for any misalignment of spring 56, coupler 50 may be provided with a radially extending flange 57 at the end of hub 51 opposite collar 52. Spring 56 is thereby compressed between flange 57 and the motor housing 43.

To the side of flange 57 opposite the spring 56, an actuator or disconnect assembly, generally indicated by the numeral 60, is located to disengage the coupler 50 from the drive gear 55. Actuator assembly 60 generally includes a yoke 61 rotatably mounted in suitable bearings 62. As shown, the ends 63 of yoke 61 are rotatably mounted in bearings 62 on either side of drive shaft 41, and the yoke's generally U-shaped member 64 spans shaft 41. U-shaped member 64 has a lower portion 65 adapted to engage the flange 56. To actuate coupler 50, yoke 61 is rotated inwardly toward motor 40, causing the lower portion 65 of U-shaped member 64 to press against flange 57, displacing coupler 50 axially inwardly toward motor 40. Displacement of coupler 50 compresses the spring 56, and once the actuator assembly 60 is released, spring 56 returns the coupler 50 to its engaged position.

An arm, generally indicated by the numeral 70, may be attached to actuator assembly 60 to facilitate actuation of yoke 61. Arm 70 is attached to yoke 61 at a first end 71 of arm 70. The opposite end 72 of arm 70 may be provided with an eyelet 73 for attaching a tensioning spring 74 and a cable 75 in a conventional manner. As shown, the tension spring 74 is fixed at one end 76 to housing 35 and at the other end 77 spring 74 attaches to arm 70. As shown, spring 74 may be attached at either end by hooks. Cable 75 is attached opposite spring 74 and extends outside of housing 35 through a U-shaped opening 78, FIG. 1, and is used to manually disengage the motor 40 such that the door D may be operated manually, as will be described below.

Figure 3:
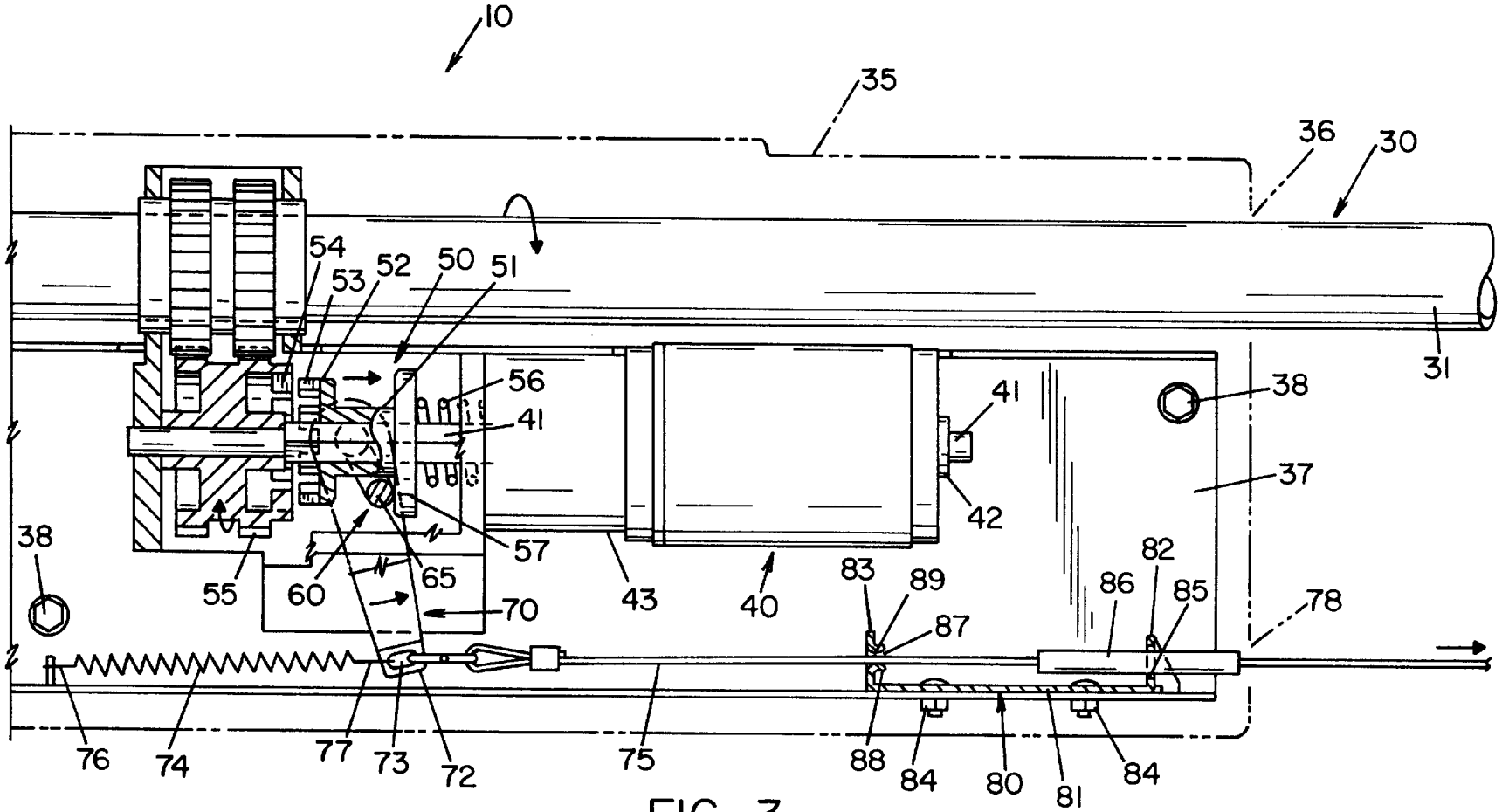
FIG. 3 is a fragmentary sectional side elevational view similar to FIG. 2 showing an operator according to the present invention having the operator cover removed, with the disconnect housing cutaway, and the disconnect arm shown in chain lines to show disengagement of a coupler.

To prevent unauthorized disengagement of motor 40 from door D, housing 35 may be fitted with a non-entry bracket generally referred to by numeral 80. Bracket 80 includes a generally U-shaped member 81 having generally vertically upstanding first member 82 and a second member 83 attached to mounting plate 37 by cap screws 84. First member 82 contains a first aperture 85. A sleeve 86 is mounted to cable 75 at a point that places it between first and second members 82, 83 when coupler 50, actuator assembly 60 and arm 70 are in their engaged position, FIG. 2. As is best shown in FIG. 3, first aperture 85 is sized to closely receive sleeve 86. Second member 83 may be provided with a second aperture 87 sized to received cable 75. Second member 83 may further be provided with an annular flange 88 to aid in guiding cable 75. The inner surface 89 of flange 88 may be rounded to reduce the wear on cable 75.

Sleeve 86 may be sized to be larger than second aperture 87 on second member 83 to prevent the tensioning spring 74 from over-drawing arm 70 and cable 75. First member 82, however, has a sleeve-receiving first aperture 85 formed therein. As shown in FIG. 3, sleeve-receiving aperture 87 is sized slightly larger than sleeve 86 to allow sleeve 86 to pass first member 82 when the disconnect 60 is used to disengage motor 40. In this way, sleeve 86 may pass through first aperture 85 in response to a substantially axial force that does not disturb the radial alignment of sleeve 86, as described below. When using a tubular sleeve 86, the centers of apertures 85, 87 are coaxial.

Figure 4:
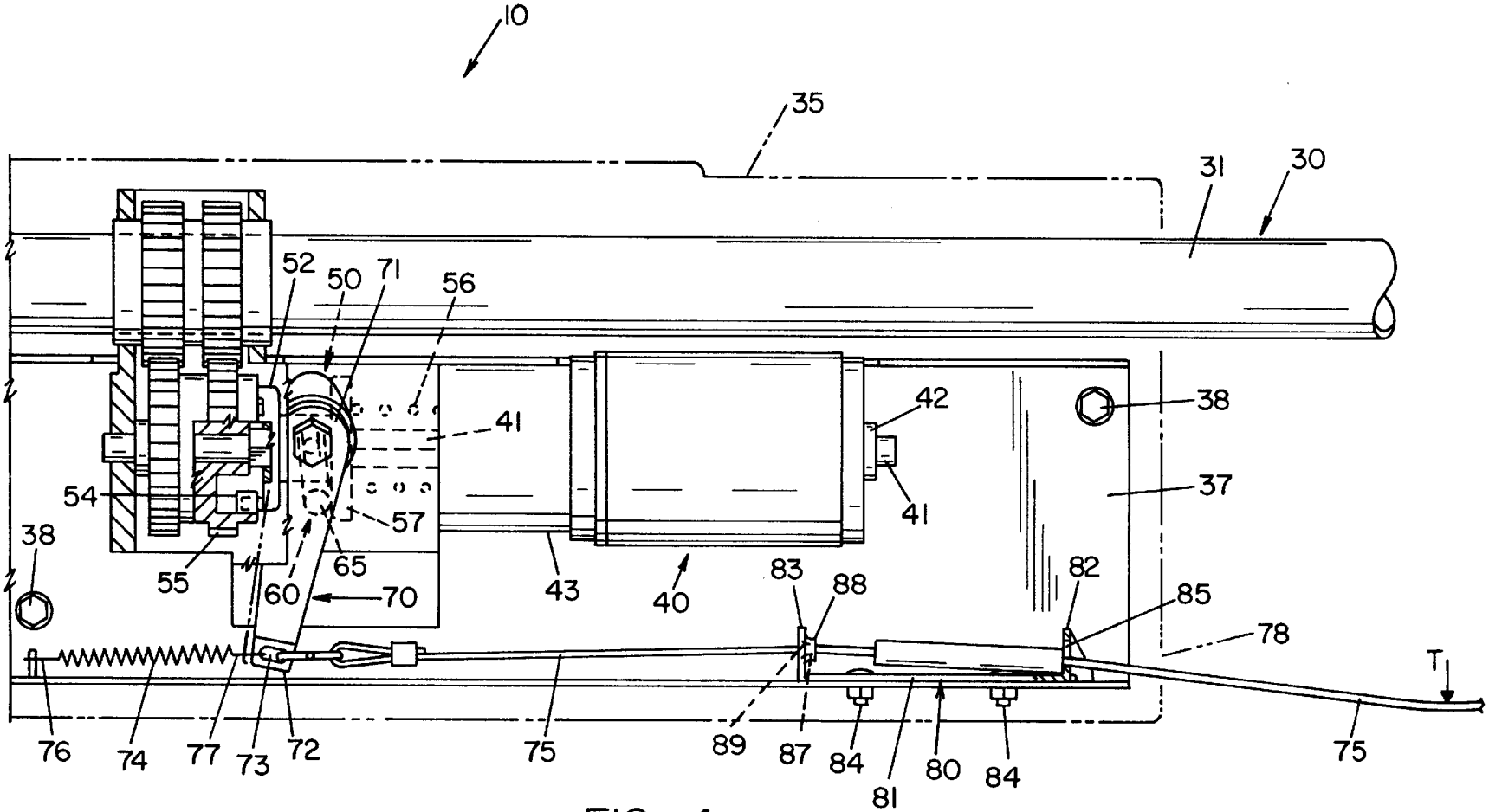
FIG. 4 is a fragmentary sectional side elevational view similar to FIGS. 2 and 3 of an operator according to the present invention having the operator cover removed to show internal detail, with the engaged position of the disconnect arm shown in phantom lines to depict slight movement of the disconnect arm and operation of the non-entry bracket and sleeve in response to an attempt to wrongfully disengage the operator for example by downwardly displacing the disconnect cable.

As best shown in FIG. 4, when the coupler 50 is engaged, the sleeve 86 rests between members 82, 83 of bracket 80. If an attempt is made to access the garage by pulling the cable 75 to disengage coupler 50, the sleeve 86 is radially deflected out of alignment with the first aperture 85 of first member 82. Since the sleeve 86 is no longer aligned with first aperture 85, the sleeve 86 cannot move through first aperture 85 but instead engages first member 82. The abutment of sleeve 86 against first member 82 stops the cable 75 from moving axially, and thus, pulling cable 75 other than in a precise axial direction, will not disengage coupler 50. For example, if the upper panel of garage door D has windows, an intruder may attempt to break a window, reach in through the window opening and pull the cable 75 downward, as shown in FIG. 4. Pulling the cable 75 downward in the direction of arrow T in FIG. 4 causes the cable 75 to displace somewhat radially, such that the motion of cable 75 carries sleeve 86 out of axial alignment with first aperture 85. In this position, the would-be intruder will not be able to advance the cable 75 through aperture 85 and thus, cannot disengage coupler 50. In contrast, normal actuation of cable 75 in the axial direction allows the sleeve 86 to pass through first aperture 85 to the disengaged position of FIG. 3.

As shown in FIG. 1, disconnect assembly 60 has a safety handle assembly, generally indicated to by numeral 90, that may be used to axially advance cable 75 in a manner that maintains alignment of sleeve 86 and first aperture 85. Safety handle assembly 90 may include an angle iron 91 that routes cable 75 to a handle bracket 92. Handle bracket 92 contains a V-shaped aperture 93 that is sized to receive cable 75 but is too small to allow passage of a handle 95. In this way, handle bracket 92 prevents retraction of handle 95 form the disengaged position of coupler 50. Tensioning of cable 75 by pulling on handle 95 permits removing the cable 75 from V-shaped aperture 93 to permit spring 56 to return coupler 50 to the engaged position. Angle iron 91 is positioned so that aperture 91' therein concentrically aligns sleeve 86 with the aperture 85 when cable 75 is tensioned by pulling down on handle 95. If desired, the cable 75 may pass through flag angle 20 in lieu of angle iron 91.

Since the operator 10 is fixed and the disconnect 50 is mounted within the operator 10, the placement of the handle 95 is largely arbitrary. The handle 95 may be remotely placed anywhere within the structure and connected to the arm 70 by cable 75. Cable 75 may be routed as necessary beyond angle iron 91 to avoid various obstructions within the garage. In addition, the handle 95 does not move other than a short vertical distance so that it is easy to locate even in the event of a power outage.

The specific location of handle 95 may be determined by the ease of access to the location and with attention to security needs. For example, handle 95 may be placed proximate the door opening to facilitate access to the handle 95 and permit the door D to be readily reached for manual actuation. With respect to security concerns, handle 95 may be placed out of the reach of windows in the door D and within the garage. Along the same lines, cable 75 is preferably routed such that it may not be readily pulled axially from outside of the garage.

The handle 95 is attached to cable 75 as by extending the cable 75 through a throughbore and restraining pull-through by a knot or clamp affixed to the cable 75, and may further include a tension adjusting assembly (not shown). The tension adjusting assembly may be used to minimize cable sag and may include a compression spring located inside the handle 95 to permit adjustment of its position axially of the cable 75.

While the operation of motorized operator system 10 is largely self-explanatory from the above description, an operating cycle proceeds essentially in the following manner. The door D is driven downwardly toward the closed position, with the teeth 53 of coupler 50 in contact with recesses 54 of drive gear 55 in the position depicted in FIG. 2 and with operator motor 40 rotating to pay out cables C. Power to the motor 40 is discontinued when the door D reaches the down or closed condition as by a signal from a limit switch or other sensor in a manner well known to persons skilled in the art.

When it is desired to open or raise the door D from the closed to the open position, motor 40 rotates in the opposite direction to take-up cables C. In a situation where the door D must be moved manually, the user pulls handle 95. In turn, cable 75 displaces arm 70, which acts to rotate yoke 61 against flange 57, thereby retracting coupler 50. Once fully retracted, the teeth 53 of coupler 50 are withdrawn from recesses 54, as depicted in FIG. 3. At this point, the motor 40 is disengaged from drive gear 55 and the counterbalance system 30 may rotate free of the motor's resistance. When the handle 95 is released, the coupler 50 may initially engage the drive gear 55 and then rotate teeth 53 into recesses 54 upon actuation of motor 40, as urged by the springs 56, 74. The arm 70, yoke 61, and coupler 50 assume and maintain the engaged position depicted in FIG. 2, such that the door D may be operated by operator motor 40.

Thus, it should be evident that the motorized operator for doors disclosed herein carries out one or more objects of the invention set forth above and otherwise constitutes an advantageous contribution to the art. As will be apparent to persons skilled in the art, modifications can be made to the preferred embodiments disclosed herein without departing from the spirit of the invention, the scope of the invention being limited solely by the scope of the attached claims.

What is claimed is:

1. An operating system for controllably moving a sectional door between open and closed positions comprising:

a counter balancing system having a drive tube interconnected with the sectional door and an operator motor mounted adjacent to said drive tube;

a drive train interconnecting said drive tube and said operator motor for selectively driving said drive tube for moving the sectional door between the open and closed positions, said operator motor having a drive shaft and said drive train including a drive gear mounted on said drive shaft and a driven gear mounted on said drive tube with said drive gear and said driven gear each having a pair of axially spaced spur gears;

a coupler in said drive train selectively retractable from a driving position; and a remotely-actuated disconnect assembly operatively attached to said coupler, wherein said disconnect assembly retracts said coupler, whereby the sectional door may be manually moved toward either of the open position and the closed position.

2. An operating system according to claim 1, wherein said coupler includes a hub carrying a flange extending radially therefrom.

3. An operating system according to claim 2, wherein said coupler is biased toward said driving position by a spring operatively engaging said flange.

4. An operating system according to claim 1, wherein said drive gear has a plurality of coupler receiving recesses and said coupler is provided with a tooth sized to be insertably received in said recesses when said coupler is in said driving position.

5. An operating system according to claim 4, wherein said coupler includes an annular hub having a flange extending radially therefrom and a crenulated collar extending axially outward from said hub adjacent said drive gear, said coupler being slidably mounted on said drive shaft.

6. An operating system according to claim 5, wherein said disconnect assembly includes a yoke rotatably mounted proximate said coupler and operatively engaging said flange, such that rotation of said yoke displaces said coupler from said driving position.

7. An operating system according to claim 6, including a spring operatively engaging said flange and said housing, whereby said spring biases said coupler toward said driving position.

8. An operating system according to claim 7, wherein said spring is a coil spring mounted on said drive shaft.

9. An operating system according to claim 7, wherein said disconnect assembly further includes an arm coupled to said yoke and a cable coupled to said arm, whereby pulling said cable disengages said coupler.

10. An operating system according to claim 1, wherein said disconnect assembly includes a cable connected to said coupler;

a bracket having a first member defining a first aperture, for receiving said cable; and a sleeve mounted on said cable adjacent said first member, wherein said first aperture is sized to receive said sleeve when said cable is pulled substantially axially.

11. An operating system according to claim 10, wherein said bracket has a second member having a second aperture axially aligned with said first aperture for receiving said cable, wherein said sleeve is positioned between said first and second members when said coupler is in said driving position.

12. An operating system according to claim 11, further comprising a handle coupled to a free end of said cable.

13. An operating system according to claim 12, wherein said handle includes a handle bracket for selectively maintaining said coupler retracted from said driving position.

14. An operating system according to claim 13, wherein said handle bracket is adapted for mounting in a fixed position.

15. An operating system according to claim 14, wherein said handle bracket has a V-shaped cable receiving aperture sized smaller than said arm, whereby said bracket stops said handle from translating toward said driving position.

16. A disconnect for an operator for controllably moving a sectional door between open and closed positions comprising:

a coupler adapted for selective interconnecting the operator and the door for moving the door between the open and closed positions when in a driving position;

a cable having a first end operatively attached to said coupler and a free end;

a sleeve mounted on said cable between said first end and said free end; and a bracket adjacent said sleeve having a first aperture sized slightly larger than said sleeve, whereby said sleeve passes through said first aperture when said cable is pulled substantially axially to move said coupler away from said-driving position.

17. A disconnect according to claim 16, wherein said bracket further comprises a second member having a second aperture coaxially aligned with said first aperture, said second aperture guidably receiving said cable.

18. A disconnect according to claim 16 wherein said bracket is fixedly mounted.

19. A disconnect according to claim 16, further comprising a handle attached to said free end of said cable for selectively controlling the position of said coupler.

20. A disconnect according to claim 19, wherein said handle includes a handle bracket for selectively maintaining said coupler retracted from said driving position.

21. An stem according to claim 20, wherein said handle bracket is adapted for mounting in a fixed position.

22. An operating system according to claim 21, wherein said handle bracket has a V-shaped cable receiving aperture sized smaller than said arm, whereby said bracket stops said handle from translating toward said driving position.

23. A disconnect for an operator for controllably moving a sectional door between open and closed positions comprising:

a coupler adapted for selectively interconnecting the operator and the door for moving the door between the open and closed positions when in a driving position;

a cable having a first end operatively attached to said coupler and a free end;

a sleeve affixed on said cable between said first end and said free end; and security lock means adjacent said sleeve permitting movement of said sleeve relative thereto only when said cable is pulled substantially axially to move said coupler away from said driving position.

24. A disconnect for an operator according to claim 23, wherein said security lock means includes a bracket having an aperture which is larger than said sleeve to permit passage of said sleeve therethrough when said cable is aligned substantially coaxially with said aperture.

25. A disconnect for an operator according to claim 24, including a handle attached at said free end of said cable and a handle bracket for selectively retaining said handle to maintain said coupler retracted from said driving position.

26. A disconnect for an operator for controllably moving a sectional door between open and closed positions comprising:

a coupler adapted for selectively interconnecting the operator and the door for moving the door between the open and closed positions when in a driving position;

a cable having a first end operatively attached to said coupler and a free end;

a stop affixed on said cable between said first end and said free end; and a security lock adjacent said sleeve permitting movement of said sleeve relative thereto only when said cable is pulled substantially axially to move said coupler away from said driving position.

27. An operating system for controllably moving a sectional door between open and closed positions comprising:

a counter balancing system having a drive tube interconnected with the sectional door and an operator motor mounted adjacent to said drive tube;

a drive train interconnecting said drive tube and said operator motor for selectively driving said drive tube for moving the sectional door between the open and closed positions;

a coupler in said drive train selectively retractable from a driving position and having a flange; and a remotely-actuated disconnect assembly including a yoke pivotally mounted to either side of said coupler and operatively engaging said flange to retract said coupler, whereby the sectional door may be manually moved toward either of the open position and the closed position.

28. An operating system for controllably moving a sectional door between open and closed positions comprising:

a counter balancing system having a drive tube interconnected with the sectional door and an operator motor mounted adjacent to said drive tube;

a drive train interconnecting said drive tube and said operator motor for selectively driving said drive tube for moving the sectional door between the open and closed positions;

a coupler in said drive train selectively retractable from a driving position and urged toward the driving position by a compression spring; and a disconnect assembly operatively attached to said coupler to selectively retract said coupler, whereby the sectional door may be manually moved toward either of the open position and the closed position, said disconnect assembly having an actuating arm movable by a cable attached thereto and extending to a remote location and having a tensioning spring attached to said actuating arm in opposed relation to said cable.

* * * * *